United States Patent [19]
Ducharme
[11] 4,294,171
[45] Oct. 13, 1981

[54] EXPLOSIVES PACKAGE FOR COUPLED CAST PRIMER COMPOSITIONS

[75] Inventor: Gilles H. Ducharme, North Bay, Canada

[73] Assignee: E. I. Du Pont de Nemours and Company, Wilmington, Del.

[21] Appl. No.: 77,543

[22] Filed: Sep. 21, 1979

[30] Foreign Application Priority Data

Sep. 21, 1978 [CA] Canada ..... 311787

[51] Int. Cl.[3] ..... C06B 11/00
[52] U.S. Cl. ..... 102/317; 206/3
[58] Field of Search ..... 102/24 R, 24 HC; 206/3

[56] References Cited

U.S. PATENT DOCUMENTS

| | | | |
|---|---|---|---|
| 3,395,642 | 8/1968 | Foster et al. | 102/24 R |
| 3,504,628 | 4/1970 | Pack et al. | 102/24 R |
| 3,731,625 | 5/1973 | Slawinski | 102/24 R |
| 3,760,728 | 9/1973 | McKee et al. | 102/24 R |
| 4,000,696 | 1/1977 | Friant et al. | 102/24 R |
| 4,199,093 | 4/1980 | Combette et al. | 206/3 X |

*Primary Examiner*—Peter A. Nelson

[57] ABSTRACT

An explosives package is disclosed comprising a plastic tubular container having male and female ends adapted to be coupled with like containers to form a column, and primer and blasting explosives contained therein. The container is open at both ends and has an internal circumferential ring seat. The ring seat and open end of the container enables a cast primer composition to be poured through the open end onto a piston which is in fluid-tight relationship with the ring seat. A capwell thimble is inserted into and retained in the side of the male end of the container so that the closed end of the capwell is situated within the cast primer composition. The male end of the container in the area of the capwell is adapted to provide protection for the legwires of a blasting cap inserted in the capwell from being nipped or damaged by other, coupled, containers or borehole walls; the protection is preferably provided by a depression around the capwell entrance and a longitudinal channel leading therefrom, on the exterior of the container. Subsequent to pouring the cast primer composition into the container and allowing the composition to solidify, the piston is removed from the container and a blasting explosive e.g. a slurry explosive in a "chub" package is inserted into the container and is retained therein by a closure disc. The primer and blasting explosive are in abutting relationship with the container.

The explosives package is particularly useful in seismic prospecting applications.

12 Claims, 4 Drawing Figures

EXPLOSIVES PACKAGE FOR COUPLED CAST PRIMER COMPOSITIONS

The present invention relates to a container for explosives and a process for filling such container with primer and main charge portions of explosives.

The term "plastic" as used herein means those synthetic thermoplastic and thermosetting polymers capable of being moulded.

In the seismic prospecting industry in which explosives are detonated at the bottom of a borehole drilled within a geologic formation, it is known to use, for example, nitroglycerin-based explosives packaged in cardboard or plastic containers.

One such plastic container, disclosed in Canadian Pat. No. 730,436 which issued Mar. 22, 1966 to J. F. Hamilton, comprises a thin-walled substantially cylindrical plastic container closed at one end, having a male thread at the closed end and a female thread at the open end. Such a container and similar ones are adapted to be interconnected with other like containers and may be filled with explosives of various types, depending on the purpose of the explosive. For example, the container may be filled with slurry explosives or nitroglycerin-based explosives. A closure cap in the open end of the container serves to seal the explosive within the container.

Blasting explosives packaged in containers as described above may be primed for inititation to detonation by punching a hole in the container and inserting a blasting cap into the punched hole. Alternatively the blasting explosive package may be connected to a booster device, and the booster device primed with a blasting cap. An example of such a booster device is disclosed in Canadian Pat. No. 823,428 which issued Sept. 23, 1969 to S. F. Foster.

It may be seen therefore that for some applications it is desirable to have an explosive package comprising a booster device and blasting explosive encased in the same container. Indeed such a package is envisioned by D. H. Pack et al in U.S. Pat. No. 3,504,628 which issued Apr. 7, 1970.

Commercial booster devices generally comprise a highly brisant explosive e.g. trinitrotoluene (TNT), cyclonite (RDX), Composition B (a mixture of TNT and RDX), which may be cast or pressed, and encased in a tubular container having suitably positioned orifices adapted to receive a blasting cap (a capwell) or detonating cord (a through-tunnel).

Most known techniques for casting or pressing explosives to form a booster having a capwell involve inserting a thimble, tube or removable core longitudinally into the confines of a tubular casing and casting or pressing the explosive within the tubular casing to surround the thimble, tube or core, leaving an open end of the thimble, tube or core at one end of the booster to form the capwell. Examples of such techniques may be found in the disclosures of G. L. Griffith in Canadian Pat. No. 973,756 which issued Sept. 2, 1975.

The main disadvantages of the explosives packages of the prior art from the users' point of view are that either two types of packages are required to be stocked by for example the seismic crew, or that packages require punching, which is generally inconvenient, especially at low temperatures. In addition, pouring molten high explosives e.g. TNT or RDX into a long closed-ended tube may not be desirable from a manufacturing standpoint because of safety considerations.

One object of the present invention is to overcome such disadvantages.

Accordingly the present invention provides a container for explosives adapted for interconnection with like containers to form a column, comprising (a) a thin-walled elongated substantially cylindrical plastic tube open at both ends;

(b) a male coupling at one end of the tube;

(c) a female coupling at the other end of the tube adapted to couple with and retain a male coupling at the end of a like container;

(d) retaining means adapted to retain a closure disc within the tube adjacent to the female coupling, between the male and female coupling;

(e) a circumferential ring seat extending into the tube and adapted to form a liquid-tight joint with a piston, said ring seat being positioned between the retaining means and the male coupling; and (f) a hole, in the wall of the tube, adapted to receive and retain a thin walled capwell thimble entirely between the ring seat and the end of the container having the male coupling.

In a preferred embodiment the container in the region of said hole is adapted to provide protection from abrasion of legwires extending from an elastic blasting cap when inserted in said capwell thimble and when the capwell thimble is retained in the hole, and to prevent said legwires from being trapped between the interlocking surfaces of the male coupling of the container and the female coupling of a like container when coupled together.

Preferably said region comprises a depression, surrounding the hole, in the outside of the male end of the container and a longitudinal groove leading from the well towards the female end of the container.

In another embodiment the container has at least one circumferential raised protector ring on the outside of the container, each protector ring having a gap therein to allow legwires of a blasting cap to lie close to and longitudinally along the outside of the tube.

In yet another embodiment the retaining means comprises a circumferential groove inside the container.

In a further embodiment the container has a thin walled plastic capwell thimble entirely between the ring seat and the end of the tube having the male coupling, the open end of the thimble facing outside the container.

Preferably the male and female couplings are threaded couplings.

The lip of the ends of the tube having the male coupling may be curled towards the longitudinal axis of the container.

The present invention also provides an explosives package adapted for interconnection with like packages to form a column, comprising (a) a thin walled elongated substantially cylindrical plastic container open at both ends;

(b) a male coupling at one end of the container;

(c) a female coupling at the other end of the container adapted to couple with and retain a male coupling at the end of a like container;

(d) a closure disc retained within the container at a position between the male and female couplings, adajcent to the female coupling.

(e) a circumferential ring seat extending into the container, positioned between the closure disc and the male couplings;

(f) a thin walled plastic capwell thimble between the ring seat and the end of the container having the male coupling, the open end of the capwell thimble facing outside the container and the thimble being adapted to receive and retain a blasting cap;

(g) a high explosive selected from the group consisting of TNT, RDX, tetryl, mixtures thereof and mixtures thereof with PETN, cast around the capwell thimble, within the container between the ring seat and the end of the container having the male coupling; and (h) a blasting explosive within the container between the ring seat and the closure disc, and in contact with said high explosive.

In a preferred embodiment the blasting explosive is a slurry explosive, preferably sensitized by monomethylamine nitrate, TNT, or flake aluminum.

In another embodiment the slurry explosive is encased in a tubular casing closed at both ends.

In yet another embodiment the high explosive is a mixture of TNT prills embedded in cast TNT, said cast TNT and prills surrounding a cap sensitive annular booster placed on the capwell thimble, or is cast pentolite i.e. a mixture of PETN (pentaerithritol tetranitrate) and TNT.

In a preferred explosives package of the invention the container in the region of the open end of the capwell thimble is adapted to provide protection from abrasion of legwires extending from an electric blasting cap when inserted in said capwell thimble, and to prevent said legwires from being trapped between the interlocking surface of the male coupling of the container and the female coupling of a like container when coupled together.

In a further embodiment the male and female couplings are threaded.

The present invention also provides a process for filling a container with explosives, said container comprising a thin-walled elongated substantially cylindrical plastic tube, open at both ends and having a retaining means adapted to retain a closure disc at one end of the tube, and the tube being adapted to receive a piston from the end of the tube having the retaining means and seat said piston on a circumferential ring seat extending into the tube, and being further adapted to receive and retain in the wall of the container, a thin walled plastic capwell thimble in the tube between the ring seat and the end of the tube farthest from said retaining means, said process comprising (a) inserting a capwell thimble into the tube and fastening the thimble to the wall of the tube, the open end of the thimble facing the outside of the tube;

(b) placing the tube over a piston and seating the piston on the ring seat of the tube in liquid-tight relationship, keeping the tube substantially vertical and the retaining means below the ring seat;

(c) casting high explosive selected from the group consisting of TNT, RDX, tetryl, mixtures thereof and mixtures thereof with PETN into the tube and onto the upper surface of the piston.

(d) removing the tube containing the cast high explosive from the piston;

(e) filling the tube, between the surface of the cast high explosive adjacent to the ring seat and the retaining means with a blasting explosive; and (f) closing the tube at the end having the retaining means by securing a closure disc to the retaining means.

In a preferred embodiment the blasting explosive is a slurry explosive, preferably sensitized with monomethylamine nitrate, TNT, or flake aluminum. Preferably step (e) comprises inserting a tubular package of slurry explosive into the container.

In another embodiment the capwell thimble is inserted through a hole in the wall of the tube and retained by the lip of the hole engaging with a cooperating groove on the capwell thimble adjacent to the open end of the thimble.

In a further embodiment an annular cap sensitive explosive booster is placed over the capwell thimble prior to step (a) of the process.

As used herein the term "in liquid-tight relationship" means sufficiently closely engaged to prevent molten castable explosives from flowing past the ring seat. It is not necessary and may not even be desirable that the piston and container be in such close liquid-tight relationship as to prevent passage of liquids less viscous than the castable high explosives e.g. water, methanol.

In yet another embodiment the high explosive is a mixture of TNT prills embedded in cast TNT or is cast pentolite.

The invention may be illustrated by reference to the accompanying drawings wherein FIG. 1 is a longitudinal cross-section of a container of the present invention.

Figure 1:
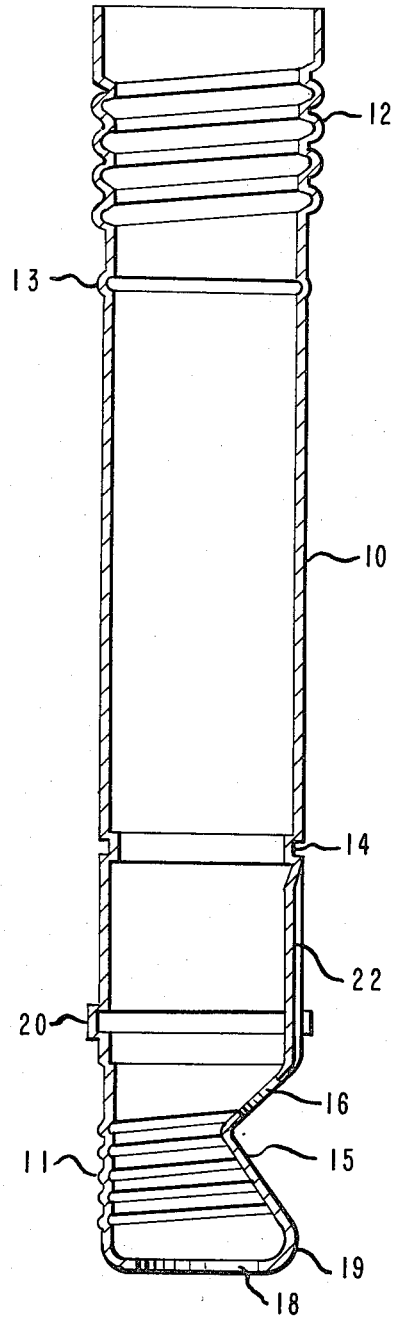
Figure 2:
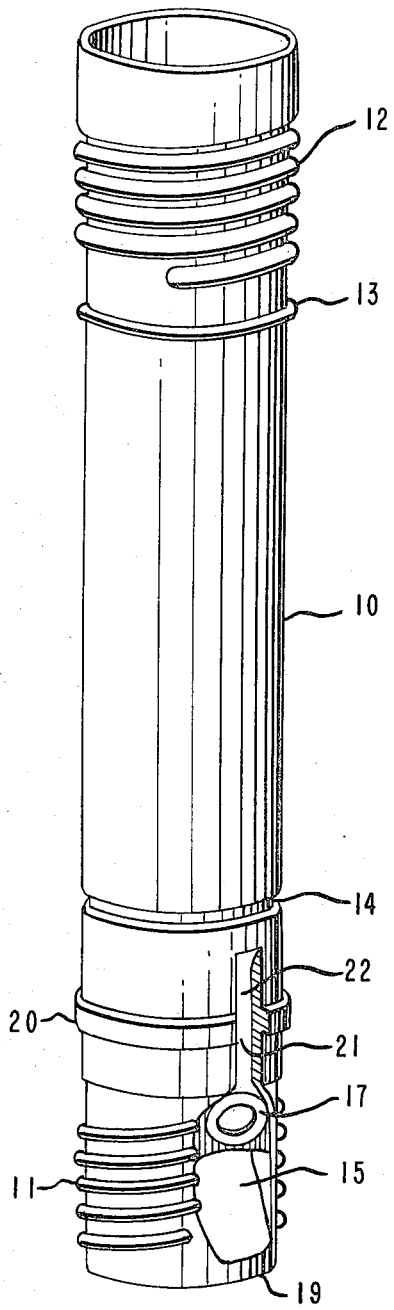
FIG. 2 is a schematic drawing of a package of the present invention.

Referring to both FIGS. 1 and 2, the container of the present invention comprises a tube 10 open at both ends. One end has a male coupling 11, shown in the drawing as a threaded coupling. The other end has a female coupling 12, shown in the drawing as a threaded coupling adapted to couple with the male coupling of a like container. The container has a circumferential groove 13 inside the tube 10 adjacent to female coupling 12, between the male and female couplings. Groove 13 serves as a retaining means for a disc, the perimeter of which seats within the groove. Between groove 13 and male coupling 11 is a circumferential ring seat 14 extending into tube 10. The tube 10 has a depression 15 in the side of threaded male coupling 11. Within depression 15 is a hole 16 in the wall of the tube. The depression is shaped to allow insertion of a capwell thimble 17 from the outside of tube 10, through hole 16. Depression 15 and hole 16 are adapted to allow the capwell thimble 17, when retained by the wall material surrounding hole 16, to be situated between ring seat 14 and the open end 18 of the tube 10 having the male coupling. The end 18 of the tube 10 having the male coupling may have its lip 19 curled in towards the longitudinal axis of tube 10, but this feature is not essential.

Optionally one or more incomplete circumferential protector rings 20 may protrude from tube 10. In FIG. 2 protector ring 20 is C-shaped, having a gap 21 in the ring. A channel 22 extending longitudinally from depression 15, in the outer surface of tube 10 extends towards female coupling 12. It is usually not necessary that channel 22 extend far along the tube. In the embodiment shown in FIG. 2 channel 22 passes through gap 21 in protector ring 20.

Figure 3:
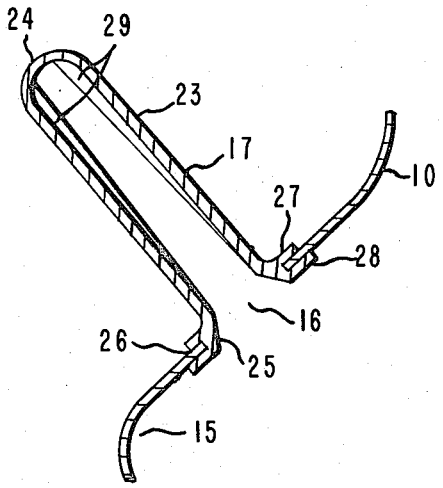
FIG. 3 is a cross-sectional view of a capwell thimble retained in a container of the present invention partially shown.

FIG. 3 shows capwell thimble 17 retained in hole 16, in greater detail. Capwell thimble 17 comprises a tube 23, closed at one end 24. The other end of tube 23 is open, and has an external flange 25 attached. Flange 25 has a peripheral groove 26 between inner lip 27 and outer lip 28 on the periphery of the flange. Peripheral groove 26 has a diameter marginally smaller than the diameter of hole 16 in the wall of tube 10 in depression 15. Inner lip 27 has a diameter marginally larger than the diameter of hole 16. Outer lip 28 has a diameter considerably larger than that of hole 16, to prevent passage of outer lip 28 through hole 16. The thicknesses of inner lip 27 and the lip of hole 16 are sufficient to impart enough flexibility to the lips to allow inner lip 27 to pass through hole 16, but stiff enough to allow the lip of hole 16 to seat within peripheral groove 26 and prevent removal of flange 25 from hole 16 without considerable force i.e. allows flange 25 to "snap-fit" into hole 16. Tube 23 may have internal longitudinal fins 29 which are adapted to diminish the effective diameter of tube 23 towards the closed end 24 of tube 23.

Figure 4:
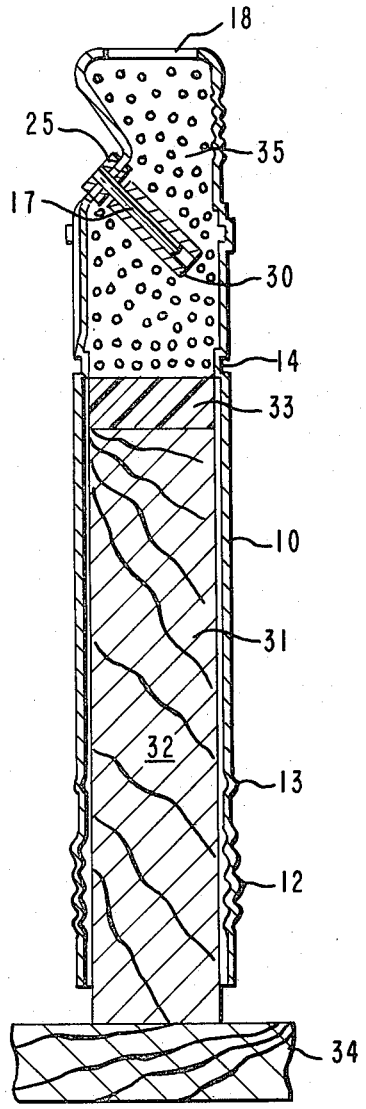
FIG. 4 is a longitudinal cross-section of a container of the present invention being filled with explosives according to the process of the present invention.

Filling of the container of the present invention is hereafter described with reference to the drawings, particularly FIG. 4.

The container of the present invention is prepared for filling with explosives by first placing an annular cap sensitive explosive 30 over the closed end of capwell thimble 17. The outer diameter of annular explosive 30 is less than the diameter of hole 16. The capwell thimble 17 is then inserted, closed end first, through hole 16, and flange 25 is "snap-fitted" into hole 16.

Tube 10 is placed, female coupling end first, over a piston which comprises a wooden shaft 32 with a nylon tip 33. The tube is allowed to move downwards until the periphery of the nylon tip 33 seats on ring seat 14. Piston 31 is attached to and extends perpendicularly from table 34. The length of piston 31 is at least as great as the distance between ring seat 14 and the end of tube 10 having female coupling 12. Once the container is thusplaced, a small amount of molten TNT is poured into tube 10 through end 18. The molten TNT falls onto the upper face of piston 31 and solidifies. A mixture of molten TNT and prilled TNT 35 is poured into tube 10 until it occupies the inner volume of tube 10 between ring seat 14 and end 18. A small volume at end 18 is usually left empty, so that molten TNT alone can be poured in, to form a smooth surface of TNT when solid, at the end of tube 10. The TNT mixture is allowed to solidify, forming a primer of high explosive at the male coupling end of the container. The container is then removed from piston 31, inverted, and slurry explosive, most conveniently in a package as disclosed in Canadian Pat. No. 1,003,693 which issued Jan. 18, 1977 to R. S. Arnew, is placed in the tube between ring seat 14, and groove 13. A flexible closure disc having a diameter about the same as the diameter of groove 13 is pushed into the tube from the female coupling end and "snapped" into groove 13. The explosives package thus formed may then be placed with similar packages in boxes for distribution to users of the packages.

It will be appreciated that blasting explosives other than slurry explosives may be used in the present invention e.g. granular nitrocarbonitrate explosives.

In use, at least one of the packages of the present invention may have a blasting cap inserted into the capwell thimble, and several packages coupled together to form a column. The package with a blasting cap inserted therein may be at the end or in the middle of the column. The blasting cap, inserted into the capwell thimble may be gripped by the fins within the thimble. The end of the blasting cap to which the legwires is attached is protected from abrasion or nipping by being situated within depression 15. The legwires of the blasting cap are protected from abrasion or nipping by laying the wires along channel 22 and between the gaps 21 in protector rings 20. The legwires are usually taped to the package for added security.

The column may have a drive-point attached thereto e.g. as disclosed in Canadian Pat. No. 827,427, which issued Nov. 18, 1969 to Graham and Rintoul to assist in holding the column in a mud-filled borehole.

The column is lowered or pushed into a borehole, as is known in the art, and the explosives column detonated through inititation of the blasting cap.

The following example illustrates the present invention:

EXAMPLE

A blow-moulded container and an injection-moulded capwell thimble, substantially as hereinbefore described, were formed using a high density polyethylene resin.

The principal dimensions of the container and capwell thimble were as follows:

| | |
|---|---|
| Length of tube | 420.0 mm |
| Outer diameter of tube between male and female ends | 56.9 mm |
| Thickness of tube | 1.525 mm |
| Outer diameter of protector ring | 60.0 mm |
| Distance between female threaded end and groove (13) | 75.0 mm |
| Indent depth of groove (13) | 1.3 mm |
| Distance between groove (13) and ring seat | 221.0 mm |
| Inner diameter of ring seat | 53.16 mm |
| Distance between female threaded end and protector ring | 339.0 mm |
| Hole (16) diameter | 19.9 mm |
| Distance between female threaded end and centre of hole (16) | 367.5 mm |
| Distance between centre of hole (16) and longitudinal axis of tube | 12.9 mm |
| Diameter of open end of tube at male threaded end | 38.0 mm |
| Length of capwell thimble | 66.5 mm |
| Outer diameter of capwell thimble: | |
| open end | 10.75 mm |
| closed end | 10.0 mm |
| Inner diameter of capwell thimble: | |
| open end | 9.0 mm |
| closed end | 8.65 mm |
| Effective inner diameter of capwell thimble at closed end (effect of four fins): | |
| open end | 7.7 mm |
| closed end | 7.35 mm |
| Diameter of inner lip of capwell thimble flange | 20.3 mm |
| Diameter of outer lip of capwell thimble flange | 22.2 mm |
| Diameter of peripheral groove of capwell thimble flange | 19.6 mm |

The angle subtended between a plane passing through the hole, and the longitudinal axis of the tube was 26°. The pitch of the male and female threaded couplings was 2° 36′, each thread extending for five complete turns.

A 76 mm length of 7.6 mm internal diameter and 12.7 mm external diameter of DETAFLEX* cap sensitive explosive was slit along its length to form a C-shaped crosssection explosive. The slit DETAFLEX explosive was pushed over the closed end of the capwell thimble. The capwell thimble and cap sensitive explosive combination were inserted and snap fitted into hole 16 in the container.

*denotes trade mark

The container was then placed, as described hereinbefore, over a nylon-tipped wooden piston 53.3 mm in diameter. About 375 g of molten and prilled TNT were poured into the container as hereinbefore described. After solidification of the TNT the container was removed from the piston and a package of slurry explosive 51 mm in diameter and 230 mm in length was slipped into the container from the female coupling end. A closure disc 55 mm in diameter was snap-fitted into groove 13. The total package weighed about 1000 g.

I claim:

1. A container for explosives adapted for interconnection with like containers to form a column, comprising a thin-walled elongated substantially cylindrical plastic tube open at both ends, said tube being provided with (a) a male coupling at one end of the tube;

(b) a female coupling at the other end of the tube adapted to couple and retain a male coupling at the end of a like container;

(c) a circumferential groove inside the tube adapted to retain a closure disc within the tube adjacent the female coupling, between the male and female coupling;

(d) a circumferential ring seat extending into the tube and adapted to form a liquid-tight joint with a piston during casting of a high explosive into the tube, said ring seat being positioned between the circumferential groove and the male coupling; and (e) a hole in the wall of the tube, adapted to receive and retain a thin-walled capwell thimble entirely between the ring seat and the end of the container having the male coupling.

2. A container according to claim 1 wherein the container in the region of said hole is adapted to provide protection from abrasion of legwires extending from an electric blasting cap when inserted in said capwell thimble and when the capwell thimble is retained in the hole, and to prevent said legwires from being trapped between the interlocking surfaces of the male coupling of the container and the female coupling of a like container when coupled together.

3. A container according to claim 2 wherein the region surrounding said hole comprises a depression, surrounding the hole, in the outside of the male end of the container and a longitudinal groove leading from the well towards the female end of the container.

4. A container according to claim 3 having in addition at least one circumferential raised protector ring on the outside of the container, each protector ring having a gap therein to allow legwires of a blasting cap to lie close to and longitudinally along the outside of the tube.

5. A container according to claim 1 additionally having a thin walled plastic capwell thimble entirely between the ring seat and the end of the tube having the male coupling, the open end of the thimble facing outside the container.

6. A container according to claim 1, 3 or 4 wherein the male and female couplings are threaded couplings.

7. An explosives packaging comprising the container of claim 1, having in addition (g) a closure disc retained by said retaining means.

(h) a thin walled plastic capwell thimble between the ring seat and the end of the container having the male coupling, the open end of the capwell thimble facing outside the container and the thimble being adapted to receive and retain a blasting cap;

(i) a high explosive selelected from the group consisting of TNT, RDX, tetryl, mixtures thereof and mixtures thereof with PETN, cast around the capwell thimble, within the container between the ring seat and the end of the container having the male coupling; and (j) a blasting explosive within the container between the ring seat and the closure disc, and in contact with said high explosive.

8. An explosives package according to claim 7 wherein the high explosive is a mixture of TNT prills embedded in cast TNT, said mixture surrounding a cap sensitive booster placed on the capwell thimble.

9. An explosive package according to claim 7 wherein the high explosive is pentolite.

10. An explosives package according to claim 7 wherein the blasting explosive is a slurry explosive.

11. An explosives package according to claim 7 wherein the container in the region of the open end of the capwell thimble is adapted to provide protection from abrasion of legwires extending from an electric blasting cap when inserted in said capwell thimble, and to prevent said legwires from being trapped between the interlocking surfaces of the male couplings of the container and the female couplings of a like container when coupled together.

12. An explosives package according to claim 7, 11 or 12 wherein the male and female couplings are threaded couplings.

* * * * *

UNITED STATES PATENT AND TRADEMARK OFFICE

CERTIFICATE OF CORRECTION

PATENT NO. : 4,294,171

DATED : OCTOBER 13, 1981

INVENTOR(S) : GILLES H. DUCHARME

It is certified that error appears in the above—identified patent and that said Letters Patent is hereby corrected as shown below:

On the printed face sheet of the patent the Assignee reading "E. I. du Pont de Nemours and Company, Wilmington, Del." should read --Du Pont Canada Inc., Montreal, Canada--.

Col. 2, line 27 - "elastic" should read --electric--.

Col. 8, line 21 - "selelected" should read --selected--.

Signed and Sealed this

*Twenty-sixth* Day of *January 1982*

[SEAL]

*Attest:*

GERALD J. MOSSINGHOFF

*Attesting Officer*

*Commissioner of Patents and Trademarks*